US007229030B2

(12) United States Patent
Shanklin et al.

(10) Patent No.: US 7,229,030 B2
(45) Date of Patent: Jun. 12, 2007

(54) SINGLE VALVE READY TO USE HOSE END SPRAYER

(75) Inventors: Donald J. Shanklin, Corona, CA (US); Ronald F. Englhard, Dove Canyon, CA (US)

(73) Assignee: Hayes Products, LLC., Buena Park, CA (US)

( * ) Notice: Subject to any disclaimer, the term of this patent is extended or adjusted under 35 U.S.C. 154(b) by 0 days.

(21) Appl. No.: 11/057,924

(22) Filed: Feb. 14, 2005

(65) Prior Publication Data

US 2005/0199751 A1 Sep. 15, 2005

Related U.S. Application Data

(60) Provisional application No. 60/546,553, filed on Feb. 20, 2004, provisional application No. 60/544,728, filed on Feb. 13, 2004.

(51) Int. Cl.
*B05B 7/30* (2006.01)

(52) U.S. Cl. ..... 239/318; 239/310; 239/413; 239/414; 239/525; 239/537

(58) Field of Classification Search ..... 239/310, 239/318, 407, 413, 414, 537, 525, 353, 354, 239/541

See application file for complete search history.

(56) References Cited

U.S. PATENT DOCUMENTS

| | | | | |
|---|---|---|---|---|
| 667,491 | A | | 2/1901 | Brigham |
| 1,813,581 | A | | 7/1931 | Rodrigues |
| 2,571,871 | A | | 10/1951 | Hayes |
| 2,719,704 | A | | 10/1955 | Anderson et al. |
| 2,764,452 | A | | 9/1956 | Anderson et al. |
| 2,788,244 | A | | 4/1957 | Gilmour |
| 2,837,374 | A | | 6/1958 | Lipman |
| 3,090,564 | A | | 5/1963 | Gilmour |
| 3,122,325 | A | | 2/1964 | Mahrt et al. |
| 3,134,545 | A | | 5/1964 | Armond |
| 3,180,580 | A | | 4/1965 | Schedel |
| 3,186,643 | A | | 6/1965 | George et al. |
| 3,207,443 | A | | 9/1965 | Gilmour |
| 3,212,716 | A | * | 10/1965 | Mills et al. ..... 239/318 |
| 3,254,844 | A | * | 6/1966 | Blasnik et al. ..... 239/318 |
| 3,258,026 | A | | 6/1966 | Weaver |
| 3,291,395 | A | | 12/1966 | Sharp |
| 3,632,083 | A | | 1/1972 | Meeks |
| 3,764,074 | A | | 10/1973 | James |
| 3,768,777 | A | | 10/1973 | Hechler |
| 3,770,205 | A | | 11/1973 | Proctor et al. |
| 3,809,124 | A | | 5/1974 | Nelson |
| 3,940,069 | A | | 2/1976 | Gunzel, Jr. et al. |
| 4,008,878 | A | | 2/1977 | Himmelman |
| RE29,405 | E | | 9/1977 | Gunzel, Jr. et al. |
| 4,121,773 | A | | 10/1978 | Headen et al. |
| 4,138,033 | A | | 2/1979 | Payne et al. |

(Continued)

*Primary Examiner*—Steven J. Ganey
(74) *Attorney, Agent, or Firm*—Knobbe, Martens, Olson & Bear, LLP.

(57) ABSTRACT

Disclosed are embodiments related to a chemical sprayer that comprises a sprayer head assembly and a container. The container defines a cavity for storing a chemical to be sprayed. A valve may be longitudinally moveable from an open position to a closed position. In the closed position, the valve may block a chemical passage, a vent passage, and a carrier fluid passage. In an open position, these passages are opened.

21 Claims, 6 Drawing Sheets

U.S. PATENT DOCUMENTS

| | | | | |
|---|---|---|---|---|
| D254,146 | S | | 2/1980 | Koenig |
| 4,281,796 | A | | 8/1981 | Fugent et al. |
| 4,349,157 | A | | 9/1982 | Beiswenger et al. |
| 4,369,921 | A | | 1/1983 | Beiswenger et al. |
| 4,475,689 | A | | 10/1984 | Hauger et al. |
| 4,508,272 | A | | 4/1985 | Thompson |
| 4,595,127 | A | | 6/1986 | Stoody |
| 4,640,461 | A | | 2/1987 | Williams |
| 4,651,930 | A | * | 3/1987 | Magaha, Jr. ..... 239/318 |
| 4,736,891 | A | | 4/1988 | Chow et al. |
| 4,750,674 | A | | 6/1988 | Chow et al. |
| 4,767,058 | A | | 8/1988 | LaRosa et al. |
| 4,811,900 | A | | 3/1989 | LaRosa et al. |
| 4,826,085 | A | | 5/1989 | Chow et al. |
| 4,838,490 | A | | 6/1989 | Nissels |
| 4,878,619 | A | | 11/1989 | Norman |
| 4,881,575 | A | | 11/1989 | Smith |
| 4,901,923 | A | | 2/1990 | McRoskey et al. |
| 4,901,976 | A | | 2/1990 | Smith |
| 4,969,603 | A | | 11/1990 | Norman |
| 5,007,588 | A | | 4/1991 | Chow et al. |
| 5,039,016 | A | | 8/1991 | Gunzel, Jr. et al. |
| 5,100,059 | A | | 3/1992 | Englhard et al. |
| 5,152,464 | A | | 10/1992 | Farley |
| 5,213,264 | A | | 5/1993 | Styne |
| 5,213,265 | A | | 5/1993 | Englhard et al. |
| 5,320,288 | A | | 6/1994 | Ketcham, Jr. |
| 5,356,076 | A | | 10/1994 | Bishop |
| 5,372,310 | A | | 12/1994 | Ketcham |
| 5,383,603 | A | | 1/1995 | Englhard et al. |
| D358,865 | S | | 5/1995 | Englhard et al. |
| 5,595,345 | A | | 1/1997 | Chura et al. |
| 5,649,664 | A | | 7/1997 | Brass et al. |
| 5,655,563 | A | | 8/1997 | Johnson |
| 5,850,973 | A | | 12/1998 | Liljeqvist et al. |
| 5,945,160 | A | | 8/1999 | Kobak et al. |
| 5,954,272 | A | | 9/1999 | Liao |
| D433,095 | S | | 10/2000 | Beauer et al. |
| 6,267,304 | B1 | | 7/2001 | Schultz |
| D451,581 | S | | 12/2001 | Shanklin et al. |
| 6,345,773 | B1 | | 2/2002 | Shanklin et al. |
| 6,378,785 | B1 | | 4/2002 | Dodd |
| 6,425,534 | B2 | | 7/2002 | Ketcham et al. |
| 6,471,141 | B2 | | 10/2002 | Smith et al. |
| 6,578,776 | B1 | | 6/2003 | Shanklin et al. |
| 6,651,901 | B2 | | 11/2003 | Jones |
| D484,572 | S | | 12/2003 | Shanklin et al. |
| 6,655,660 | B2 | | 12/2003 | Wales |
| 6,672,520 | B2 | | 1/2004 | Shanklin et al. |
| 6,726,123 | B2 | | 4/2004 | Wang |
| 6,749,133 | B1 | | 6/2004 | Ketcham et al. |
| 6,772,966 | B2 | | 8/2004 | Foster et al. |
| 2004/0118944 | A1 | | 6/2004 | Amaduzzi |
| 2004/0124263 | A1 | | 7/2004 | Seeman |
| 2004/0140372 | A1 | | 7/2004 | Englhard et al. |

* cited by examiner

SINGLE VALVE READY TO USE HOSE END SPRAYER

RELATED APPLICATIONS

This application claims priority pursuant to 35 U.S.C. 119(e) to now abandoned U.S. Provisional Patent Application Ser. Nos. 60/544,728, filed Feb. 13, 2004, and 60/546,553, filed Feb. 20, 2004, which are hereby incorporated by reference in their entirety.

BACKGROUND OF THE INVENTION

1. Field of the Invention

The present invention relates to chemical dispensing sprayers and, in particular, to aspiration-type sprayers that use a relatively large amount of carrier fluid for dispensing a relatively small amount of a chemical solution.

2. Description of the Related Art

Every year consumers apply thousands of gallons of chemicals such as fertilizers or pesticides to plants, lawns, flowers, vegetable gardens and other organic type vegetation. Typically, such chemicals are sold in plastic containers in a concentrated form. While in this concentrated form, the chemical is extremely hazardous to the consumer end user and the environment in general. Accordingly, the container typically includes an aspiration-type sprayer head assembly. An aspiration-type sprayer uses a relatively large amount of carrier fluid, such as water, to withdraw, dilute and dispense a relatively small amount of chemical from the container. To further prevent harm to the consumer, the container and the sprayer head assembly are preferably disposed of after the container's contents are exhausted. It is therefore desirable to provide a sprayer head assembly that is sufficiently low cost so as to allow the entire unit to be discarded and yet reliable and safe.

SUMMARY OF THE INVENTION

Therefore in a preferred embodiment, one object is to provide a safe and reliable aspiration type chemical sprayer that utilizes a minimum number of components and that is relatively easy to manufacture and assemble.

Accordingly, in a preferred embodiment, the chemical sprayer includes a sprayer head assembly and a container. The container defines a cavity for storing a chemical to be sprayed. A portion of the sprayer head assembly is longitudinally moveable from an open position to a closed position. In the closed position, the portion blocks a chemical passage, a vent passage and a carrier fluid passage. In an open position, these passages are opened.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

BRIEF DESCRIPTION OF THE DRAWINGS

These and other features of the invention will now be described with reference to the drawings of the preferred embodiments, which are intended to illustrate and not to limit the invention, and in which.

DETAILED DESCRIPTION OF THE PREFERRED EMBODIMENT

Figure 1A:
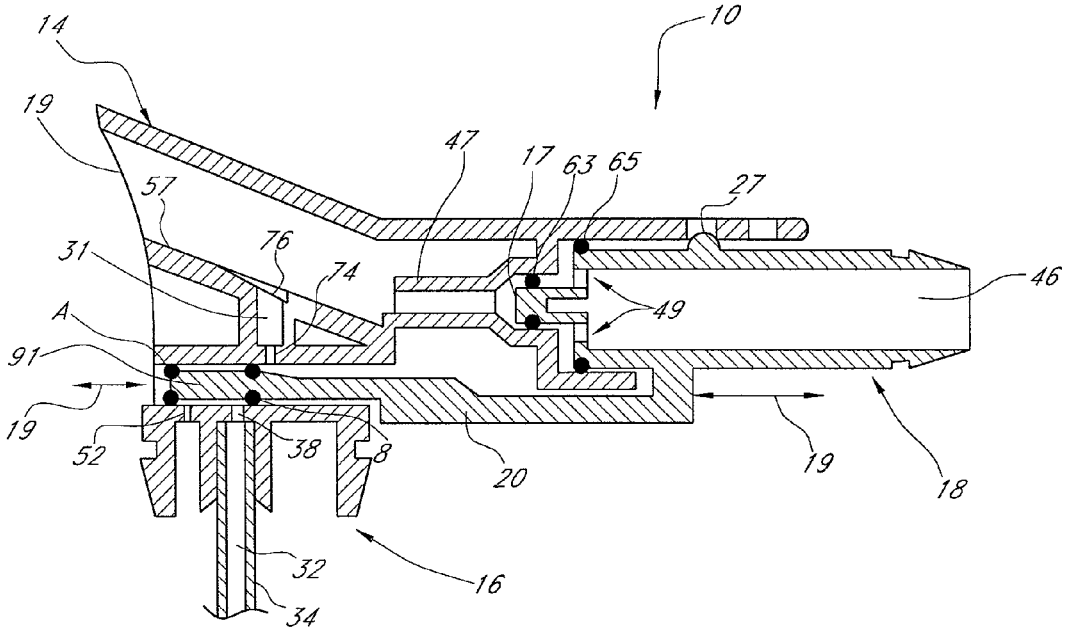
FIG. 1A is a cross-sectional view of an exemplary sprayer head assembly in a closed position.
Figure 1B:
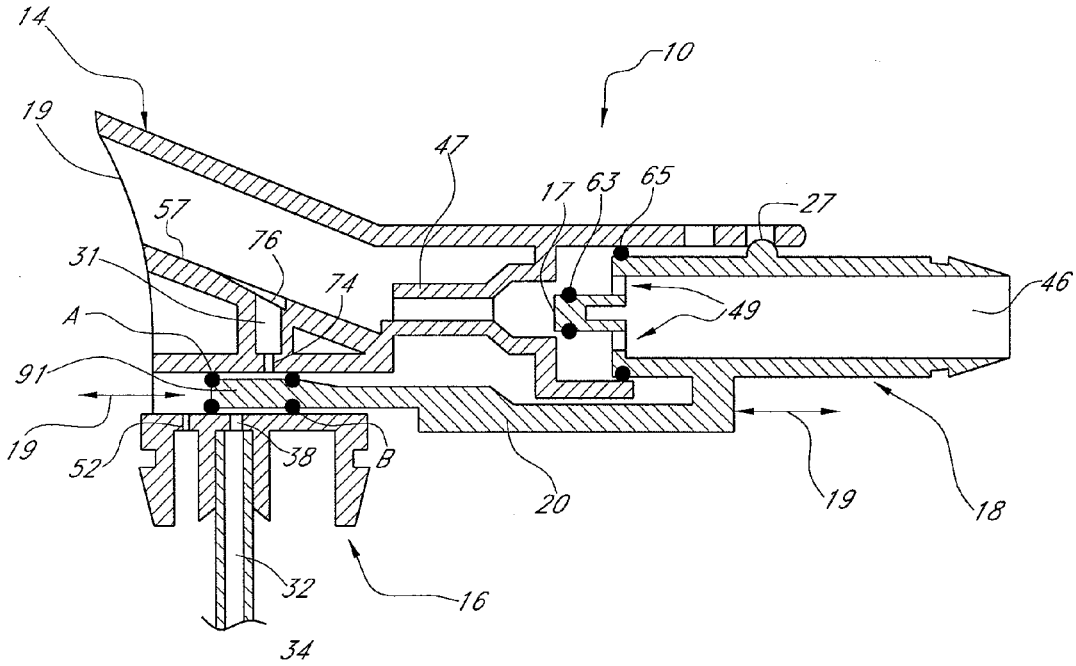
FIG. 1B is a cross-sectional view of an exemplary sprayer head assembly in an open position.

A sprayer head assembly 10 according to an exemplary embodiment is illustrated in FIGS. 1A and 1B. The sprayer head assembly 10 is connected to a chemical container (not shown). The sprayer head assembly 10 includes a sprayer head 14, a container connection portion 16 and a supply fluid connection portion 18. The sprayer head assembly 10 may be made of any suitable material that is resistant to and compatible with the chemical fluid to be sprayed. However, a flexible plastic material, such as polypropylene, is preferred because it is resilient yet durable. The sprayer head 14 also defines, at least in part, an outlet 19 of the sprayer head assembly 10.

With reference to FIG. 1, the supply fluid connection portion 18 is coupled to a slide or sliding member 20, which in the illustrated embodiment lies between the sprayer head 14 and the container connection portion 16. As will be explained below, the sliding member 20 and the sprayer connection portion 18 are moveable in a longitudinal direction (see arrows 19 in FIGS. 1A and 1B) with respect to the container connection portion 16 and the sprayer head 14. An operator opens and closes the sprayer 10 by pulling or pushing the supply fluid connection portion 18 with respect to the container connection portion 16.

Figure 2A:
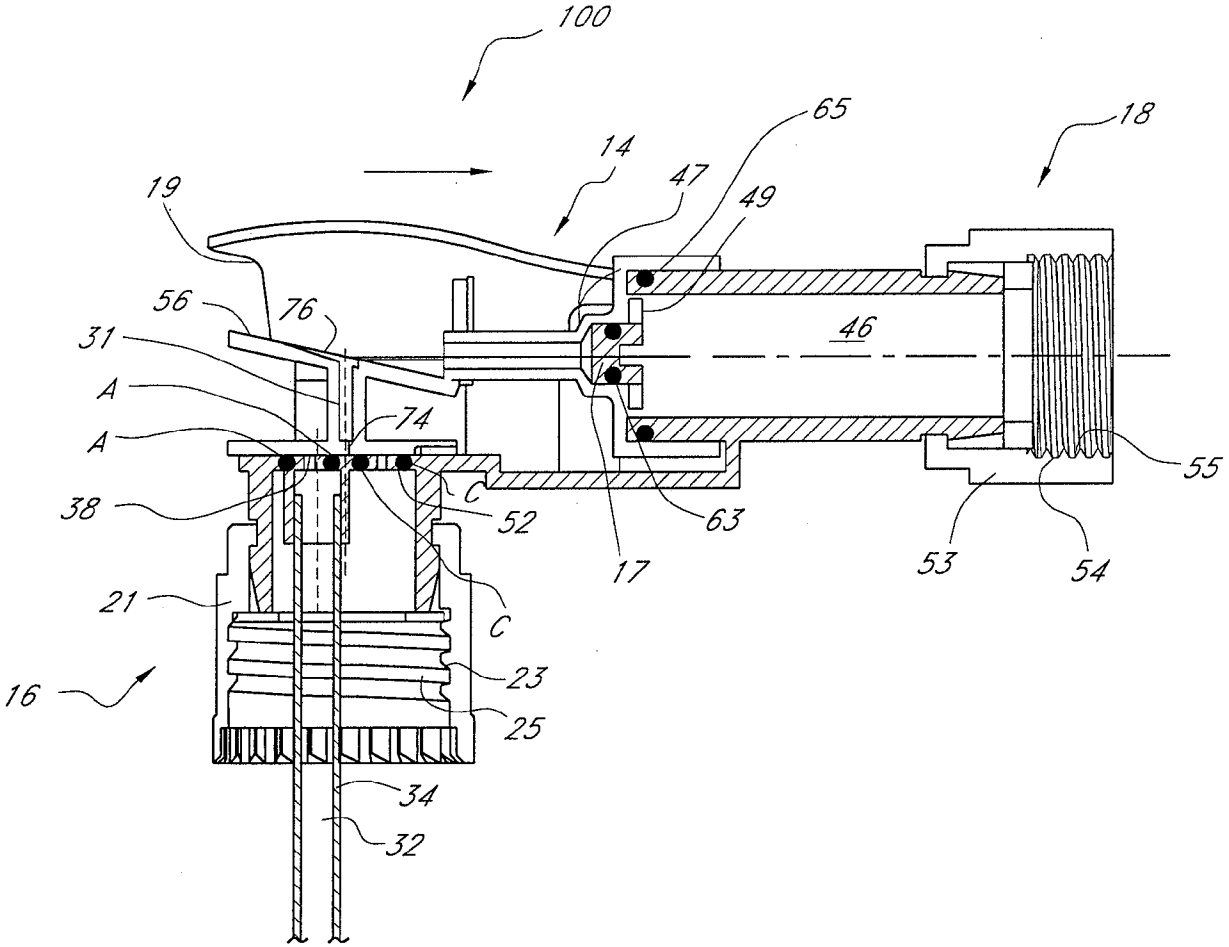
FIG. 2A is a cross-sectional view of another embodiment of an exemplary sprayer head assembly in a closed position.
Figure 2B:
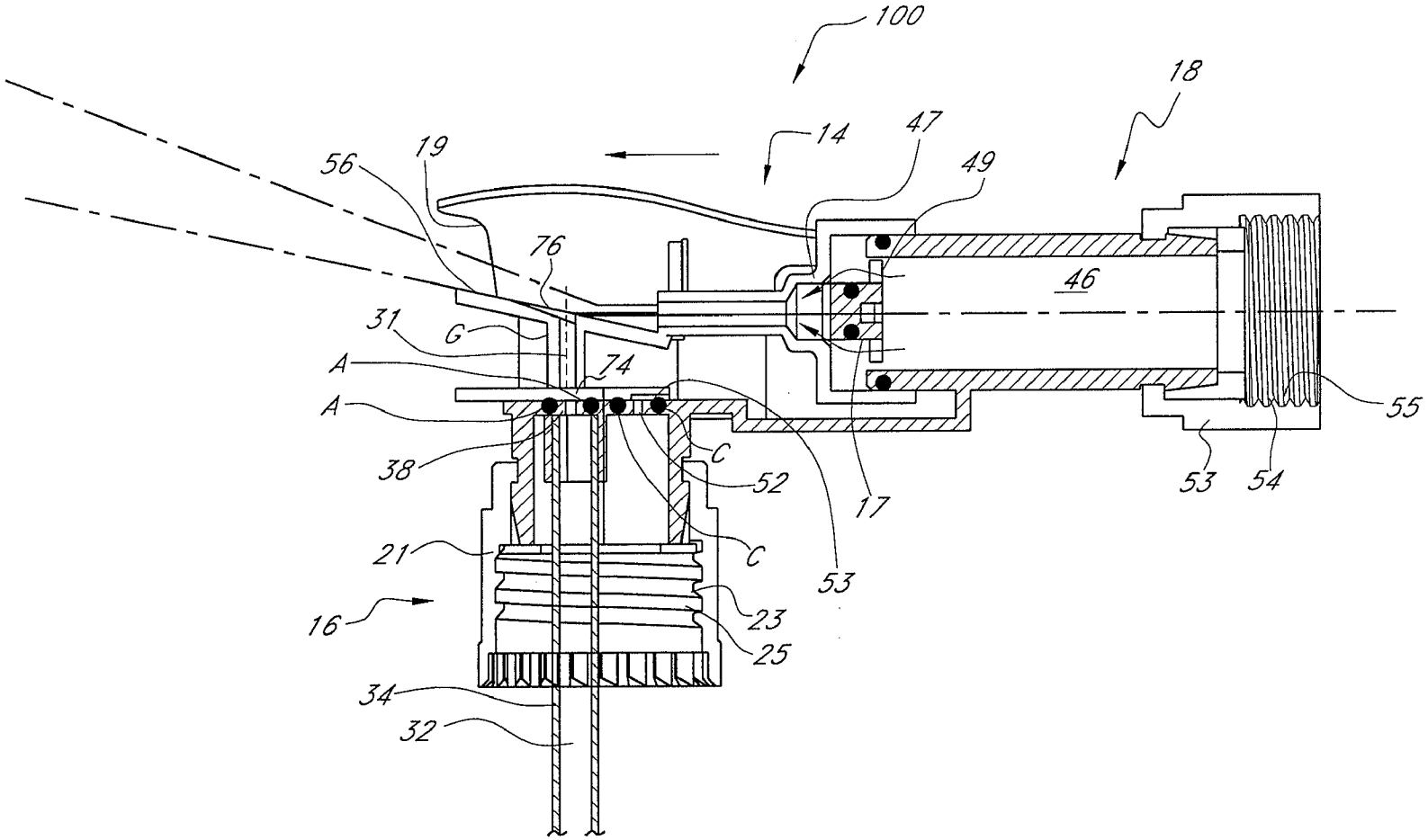
FIG. 2B is a cross-sectional view of the sprayer head assembly of FIG. 2A in an open position.

As illustrated in FIGS. 2A and 2B, the connection between the sprayer head assembly 10 and the container can be achieved by providing the container connection portion 16 with a conventional rotatable coupler 21 and a washer. The rotatable coupler 21 may include internal threads 23 that cooperate with corresponding threads 25 formed on the neck of the container.

The sprayer head assembly 10 can also be permanently attached to the container. In such an arrangement, adhesive can be applied to the inner surface of the connection portion 16 before it is fitted over the neck of the container. Alternatively, the connection portion 16 can include an inwardly projecting ratchet that opposes a cooperating ratchet formed on the container. Other ways of attaching the sprayer head assembly 10 to the container may also be used.

When the sprayer head assembly 10 is installed onto the container, the interior of the container is in communication with a chemical passage 32. As in the illustrated arrangement, the chemical passage 32 may be defined in part by a downwardly depending chemical flow tube or dip tube 34. The dip tube 34 extends into the container and preferably terminates near a bottom surface of the container. The chemical passage 32 is also defined in part by an internal passage 38, which is formed in the connection portion 16. Although, in the illustrated arrangement the chemical passage 32 is defined by two components (the dip tube 34 and the internal passage 38), it should be appreciated that the chemical passage 32 can be defined by a single component or more than two components. The illustrated arrangement, however, is preferred because it is easy to manufacture and yet uses a small number of components.

Preferably, the sprayer head assembly 10 includes a vent passage 52. In the illustrated arrangement, the vent passage 52 is defined by a small hole formed in the container connection portion 16. As with the chemical passage 32, the vent passage 52 communicates with the interior of the container when the assembly 10 is mounted onto the container. In the illustrated embodiment, the vent passage 52 lies generally parallel to (and spaced apart from) the interior passage 32. Although, in the illustrated arrangement the vent passage 52 is formed on the assembly 10, it should be appreciated that the vent passage 52 can be located on the container. However, the illustrated arrangement is preferred because, as will be explained below, it enables the vent passage 52 to be opened and closed with the chemical passage 32.

As mentioned above, the sprayer head assembly 10 also includes a supply fluid connection portion 18. The supply fluid connection portion 18 connects the assembly to a pressurized supply fluid source, as illustrated in FIGS. 2A and 2B, such as, for example, a garden hose. The connection may be formed by a conventional rotatable coupler 53 and a washer. The coupler 53 may include threads 54 that cooperate with corresponding threads 55 formed on the supply fluid source. One of ordinary skill in the art will appreciate that other devices can be used to connect the assembly 10 to the supply fluid source.

The sprayer head assembly 10 includes a supply passage 46. The supply passage 46 is in communication with a supply fluid nozzle 47 through a plurality of openings 49. As shown in FIGS. 1A and 1B, the supply fluid connection portion 18 includes a plunger 17, which fits within the supply fluid nozzle 47. The plunger may include sealing members 63 (e.g., O-rings) such that when the connection portion 18 is in the closed position water can not flow from the carrier fluid passage 46 into the supply fluid nozzle 47. The supply fluid connection portion 18 may be provided with a second sealing member 65 for reducing/preventing leakage between the housing 14 and the fluid supply connection portion 18 in the closed or open positions.

As will be explained below, the sliding member 20 controls the flow of chemical through the assembly 10 and preferably the sliding member 20 also controls the communication of the vent passage 52 with atmospheric pressure.

Accordingly, the sliding member 20 includes a pair of sealing members A, B (e.g., O-rings). In between the sealing members A, B, the sliding member 20 defines a seal section or reduced diameter portion 91. In a closed position, which is illustrated in FIG. 1A, the reduced diameter portion 91 lies above the chemical passage 38 and the vent passage 52 with the sealing members A, B lying on both sides of the chemical passage and the vent passage 52. In this manner, chemical is prevented from escaping and chemical cannot flow into a chemical passage 31 formed in the housing 14. In an open position, which is illustrated in FIG. 1B, the sliding member 20 is pulled rearwardly and until the forward sealing member A lies on the other side of the vent passage 52 thereby permitting the vent passage to communicate with the atmosphere. In this position, the reduced diameter portion 91 places the chemical passage 32 in fluid communication with the chemical passage 31 in the housing. In this same position, the plunger 17 is withdrawn from the nozzle 47 such that carrier fluid can flow into the housing 14.

The chemical passage 31 in the housing preferably communicates with a generally cylindrical metering orifice 74 and preferably terminates within a graduated suction generating recess 76, which is formed on a surface, preferably a suction generating surface 57.

The diameter of the metering orifice 74 determines, for the most part, the dilution ratio of the sprayer head assembly 10. The method for determining the diameter of the metering orifice to achieve a desired dilution ratio are well known to those of ordinary skill in the art; therefore, a detailed description of such a method is not necessary.

The surface 57 defines the graduated suction generating recess 76. The recess 76 has a generally triangular shape that is formed by two side walls and a rounded end wall. A mouth of the metering orifice lies on a lower face of the recess 76 near the rounded end wall. The recess 76 is deepest at the apex where the mouth of the metering orifice 74 is located. The graduated suction generating recess 76 is sized and configured, as is well known in the art, so that when carrier fluid flows over the recess 76 a suction force is created. The suction force draws the chemical from the container 12 through the chemical passage 32. Of course, one of ordinary skill in the art will recognize that the desired suction force can be created with graduated suction generating recesses of other shapes and sizes and in some embodiments without a suction generating recess.

It should be appreciated that the sealing members may be formed in several different manners. In one embodiment, the sealing portion is formed from a separate single sealing member that is positioned within a recess formed on the valve 20 (e.g., an O-ring). The sealing member is preferably made of a soft plastic elastomer material or other suitable synthetic rubber material. In other embodiments, the sealing members may be formed by integrally forming or coating an elastomer, rubber or rubber like material to form a tight seal.

A detent 27 and corresponding opening may be provided between the housing 14 and the connection portion 18 to indicate and lock the assembly 10 in a closed or open position.

FIGS. 2A and 2B illustrate another embodiment of a sprayer head assembly 100 wherein the same reference numbers have been used to identify components that are similar to components of the previous embodiment. In this embodiment, the sprayer head assembly 100 is connected to a chemical container (not shown). The sprayer head assembly 100 includes a sprayer head 14, a container connection portion 16 and a supply fluid connection portion 18. The sprayer head assembly 100 desirably may be made of any suitable material that is resistant to and compatible with the chemical fluid to be sprayed. However, a flexible plastic material, such as polypropylene, is preferred because it is resilient yet durable.

In this embodiment, the housing 14 is moveable with respect to the container connection portion 16 and the supply fluid connection portion 18. As illustrated by the arrows in FIGS. 2A and 2B and explained below, the housing 14 is moveable in a longitudinal direction with respect to the container connection portion 16 and the supply fluid connection portion 18.

Although the container is not illustrated, the connection between the sprayer head assembly 100 and the container can be achieved by providing the container connection portion 16 with a conventional rotatable coupler and a washer. The rotatable coupler may include internal threads that cooperate with corresponding threads (not shown) formed on the neck of the container.

The sprayer head assembly 100 can also be permanently attached to the container. In such an arrangement, adhesive can be applied to the inner surface of the supply fluid connection portion 16 before it is fitted over the neck of the container. Alternatively, the supply fluid connection portion 16 can include an inwardly projecting ratchet that opposes a cooperating ratchet formed on the container.

When the sprayer head assembly 100 is installed onto the container, the interior of the container is in communication with a chemical passage 32. In the illustrated arrangement, the chemical passage 32 is defined in part by a downwardly depending chemical flow tube or dip tube 34. The dip tube 34 extends into the container and preferably terminates near a bottom surface of the container. The chemical passage 32 is also defined in part by an internal passage 38, which is formed in the connection portion 16. Although in the illustrated arrangement the chemical passage 32 is defined by two components (the dip tube 34 and the internal passage 38), it should be appreciated that the chemical passage 32 can be defined by a single component or more than two components. The illustrated arrangement, however, is preferred because it is easy to manufacture and yet uses a small number of components.

Preferably, the sprayer head assembly 100 includes a vent passage 52. In the illustrated arrangement, the vent passage 52 is defined by a small hole formed in the container connection portion 16. As with the chemical passage 32, the vent passage 52 communicates with the interior of the container when the assembly 100 is mounted onto the container. In the illustrated embodiment, the vent passage 52 lies generally parallel to (and spaced along the axis of the valve from) the interior passage 32. Although, in the illustrated arrangement the vent passage 52 is formed on the assembly 100, it should be appreciated that the vent passage 52 can be located on the container. However, the illustrated arrangement is preferred because, as will be explained below, it enables the vent passage 52 to be opened and closed with the chemical passage 32.

As mentioned above, the sprayer head assembly 100 also includes a supply fluid connection portion 18. The supply fluid connection portion 18 connects the assembly to a pressurized supply fluid source (not shown), such as, for example, a garden hose. The connection may be formed by a conventional rotatable coupler and a washer (FIGS. 2A and 2B). The coupler may include threads that cooperate with corresponding threads formed on the supply fluid source. One of ordinary skill in the art will appreciate that other devices can be used to connect the assembly 100 to the supply fluid source.

The sprayer head assembly 100 forms a supply passage 46. The supply passage 46 is in communication with a supply fluid nozzle 47 through a plurality of openings 49. As shown in FIGS. 2A and 2B, the supply fluid connection portion 18 includes a plunger 17, which fits within the supply fluid nozzle 47. When the housing 14 (see FIG. 2A) is in the closed position, water can not flow from the carrier fluid passage 46 into the supply fluid nozzle 47 because the sealing plunger 17 fits tightly within the nozzle 47. The plunger may include a sealing member 63 (e.g., O-ring) such that when the connection portion 18 is in the closed position water can not flow from the carrier fluid passage 46 into the supply fluid nozzle 47. The supply fluid connection portion 18 may be provided with a second sealing member 65 for reducing/preventing leakage between the housing 14 and the fluid supply connection portion 18 in the closed or open positions.

As explained below, movement of the housing 14 also preferably opens and closes the internal passage 38 and, more preferably, also open and closes the vent passage 52. The housing 14 includes an first passage 31, which, in the open position (see FIG. 2B), is aligned with the internal passage 38 such that it is in communication with the cavity of the container. A sealing member A preferably provides a seal between the internal passage 38 and the first passage 31 in the open position. In the illustrated embodiment, the sealing member A is positioned on the chemical connection portion 16 but in another embodiment may be positioned on the housing 14 or both components. With reference to FIG. 2A, in a closed position, the first passage 31 is not aligned with the internal passage 38 and the sealing member A provides a seal between the two passages 31, 38. The sealing member A in the closed position preferably also provides a seal between the internal passage 38 and the housing 14 and chemical connection portion 16 to prevent leaks in the closed position.

In a similar manner, movement of the housing 14 preferably opens and closes the vent passage 52. With reference to FIG. 2B, in the open position, a vent opening 53 formed in the housing 14 lies over vent passage 52 to place the container in communication with the atmosphere (e.g., by providing a gap G or opening in the housing 14). In a closed position (see FIG. 2A), the housing 14 closes the vent passage 52. A sealing member C preferably provides a seal between the vent passage 52 and the housing 14 to prevent leakage in the closed position. In the illustrated embodiment, the sealing member C is positioned on the chemical connection portion 16, but in other embodiments the sealing member may be positioned on the housing 14 or both members.

With respect to the housing 14, the first passage 31 preferably terminates within a graduated suction generating recess 76, which is formed on a surface 56 formed in the housing 14 and arranged such that carrier fluid discharged from the nozzle 47 generally flows over the surface 56, The first passage 31 preferably includes a cylindrical metering orifice 74. The diameter of the metering orifice 74 determines, for the most part, the dilution ratio of the sprayer head assembly 10. The method for determining the diameter of the metering orifice to achieve a desired dilution ratio are well known to those of ordinary skill in the art; therefore, a detailed description of such a method is not necessary.

The surface 56 defines the graduated suction generating recess 76. In one embodiment, the recess 76 has a generally triangular shape that is formed by two side walls and a rounded end wall. A mouth of the metering orifice lies on a lower face of the recess 76 near the rounded end wall. The recess 76 is deepest at the apex where the mouth of the metering orifice 74 is located. The graduated suction generating recess 76 is sized and configured, as is well known in the art, so that when carrier fluid flows over the recess 76 a suction force is created. The suction force draws the chemical from the container through the chemical passages 32, 31. Of course, one of ordinary skill in the art will recognize that the desired suction force can be created with graduated suction generating recesses of other shapes and sizes and in some embodiments without a suction generating recess.

Figure 3A:
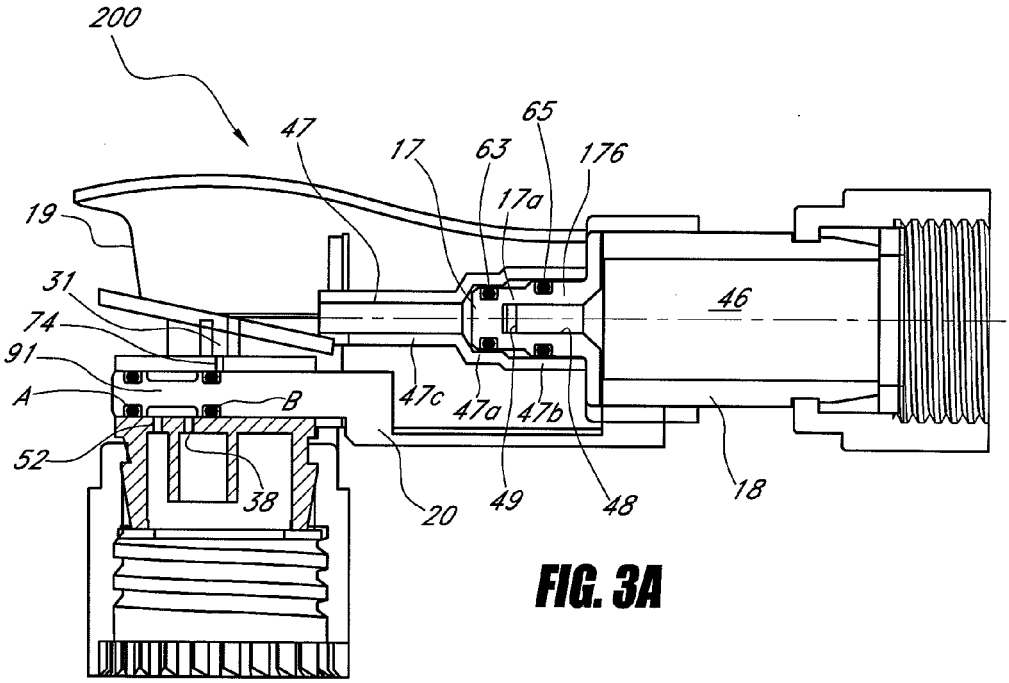
FIG. 3A is a cross-sectional side view of another embodiment of an exemplary sprayer head assembly in a closed position.

FIGS. 3A–4C illustrate another embodiment of a sprayer head assembly 200 wherein the same reference numbers have been used to identify components that are similar to components of the previous embodiments. With reference to FIG. 3A, the sprayer head assembly 200 is shown in a closed position.

The sprayer head assembly 200 preferably includes a supply passage 46. The supply passage 46 is in communication with a supply fluid nozzle 47 through a plurality of openings 49. The supply fluid connection portion 18 includes a plunger 17, which fits within the supply fluid nozzle 47. The plunger 17 may include sealing members 63 such that when the connection portion 18 is in the closed position water can not flow from the carrier fluid passage 46 into the supply fluid nozzle 47. The supply fluid connection portion 18 may be provided with a second sealing member 65 for reducing/preventing leakage between the housing 14 and the fluid supply connection portion 18 in the closed or open positions.

As shown in FIG. 3A, the plunger 17 may comprise portions with different cross-sectional measurements. For example, in FIG. 3A, the plunger 17 is shown having two portions, the forward portion 17*a* having an external diameter that is less than that of the rearward portion 17*b*. Additionally, the supply fluid nozzle 47 may also have portions with different cross-sectional measurements. As illustrated, the supply fluid nozzle 47 may have three portions, which each have a different internal diameter. A first portion 47*a* of the supply fluid nozzle 47 may have an internal diameter that is configured to accommodate the external diameter of the forward portion 17*a*, thereby permitting the forward portion 17*a* to be received therein and permitting axial movement of the forward portion 17*a* with respect to the supply fluid nozzle first portion 47*a*. Further, a second portion 47*b* of the supply fluid nozzle 47 may have an internal diameter that is configured to accommodate the external diameter of the rearward portion 17*b*, thereby permitting the rearward portion 17*b* to be received therein and permitting axial movement of the rearward portion 17*b* with respect to the supply fluid nozzle second portion 47*b*.

The external surfaces of the forward and rearward portions 17*a*, 17*b* are preferably configured to permit placement thereon of the sealing members 63, 65. When in the closed position, the sealing member 63 is configured to reduce/prevent fluid communication between the supply fluid nozzle second portion 47*b* and a supply fluid nozzle third portion 47*c*. The sealing member 65 is configured to reduce and, preferably, prevent leakage between the housing 14 and the fluid supply connection portion 18 in the closed or open positions.

Figure 3B:
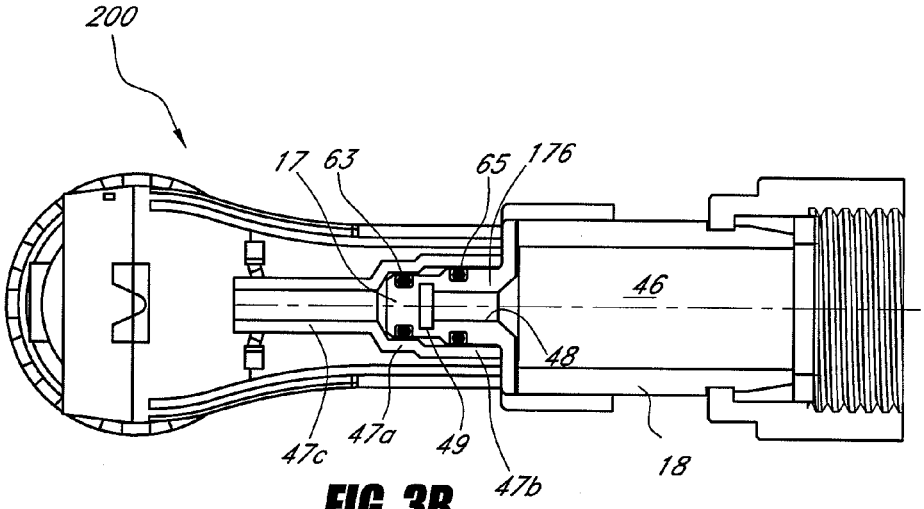
FIG. 3B is a cross-sectional top view of the sprayer head assembly of FIG. 3A in a closed position.

The plunger 17 also preferably has a lumen 48 in fluid communication with the supply passage 46 and that extends from one end of the plunger 17 to an intermediate point thereof. The plunger also preferably includes a plurality of openings 49 that provide fluid communication between the plunger lumen 48 and the supply fluid nozzle 47. In the closed position, as illustrated in FIGS. 3A and 3B, fluid communication is permitted between the supply passage 46 and the supply fluid nozzle second portion 47*b* through the lumen 48, but the sealing member 63 reduces/prevents fluid communication between the supply fluid nozzle second portion 47*b* and the third portion 47*c* because of the sealing member 63.

Figure 4A:
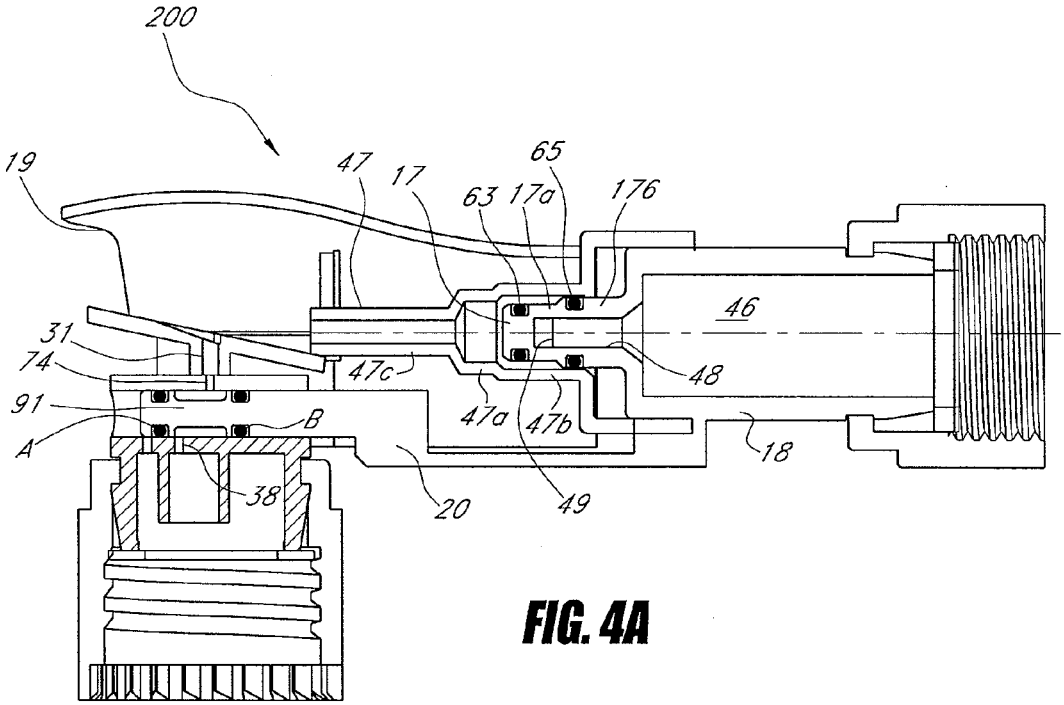
FIG. 4A is a cross-sectional side view of the sprayer head assembly of FIG. 3A in an open position.
Figure 4B:
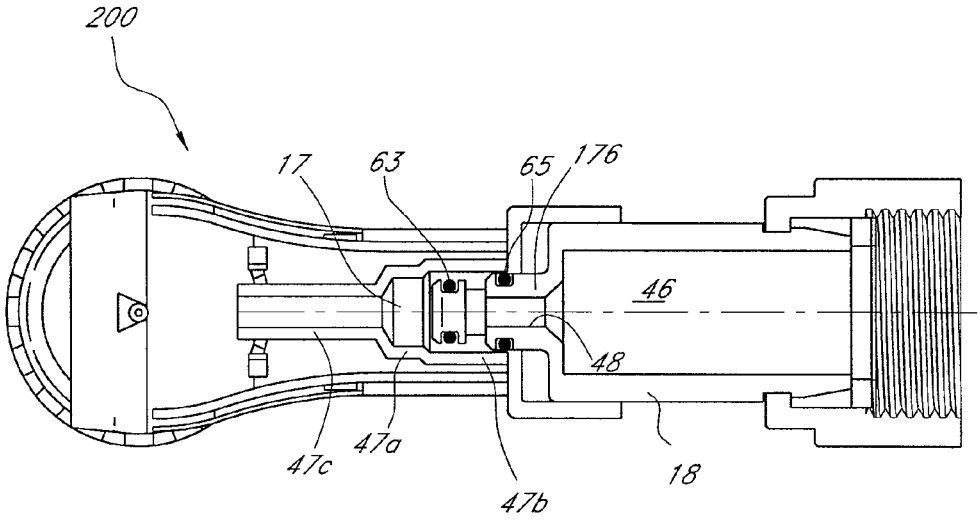
FIG. 4B is a cross-sectional top view of the sprayer head assembly of FIG. 3A in an open position.
Figure 4C:
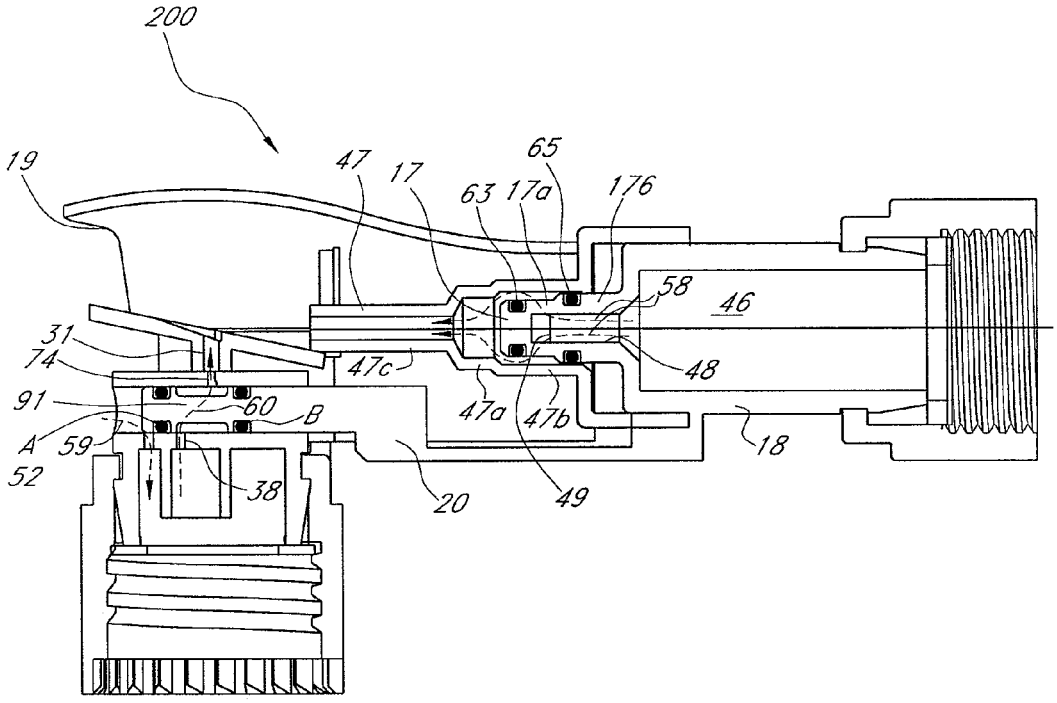
FIG. 4C is a cross-sectional side view of the sprayer head assembly of FIG. 3A in an open position illustrating flow paths with arrows.

As illustrated in FIGS. 4A–4C, when the sprayer head assembly 200 is in the open position, such as when the connecting portion 18 is drawn rearward, the plunger 17 is likewise drawn rearward, and the sealing member 63 enters into the supply fluid nozzle second portion 47*b*. Because the second portion 47*b* has a greater cross-sectional measurement than the first portion 47*a*, the sealing member 63 is configured to permit fluid communication between the second portion 47*b* and the third portion 47*c*, thereby permitting fluid to be ejected from the supply fluid nozzle 47. As illustrated by the flow arrows 58 of FIG. 4C, in the open position, the fluid is permitted to flow from the supply passage 46 through the lumen 48 and the openings 49 and into the second portion 47*b*. The fluid then passes around the sealing member 63 and through the first and third portions 47*a*, 47*c*.

As will be explained below, the sliding member 20 controls the flow of chemical through the assembly 10 and preferably the sliding member 20 also controls the communication of the vent passage 52 with atmospheric pressure.

The sliding member 20 includes a pair of sealing members A, B. In between the sealing members A, B, the sliding member 20 defines a seal section or reduced diameter portion 91. In a closed position, which is illustrated in FIG. 3A, the reduced diameter portion 91 lies above the chemical passage 38 and the vent passage 52 with the sealing members A, B lying on both sides of the chemical passage and the vent passage 52. In this manner, chemical is prevented from escaping and chemical cannot flow into a chemical passage 31 formed in the housing 14. In an open position, which is illustrated in FIG. 4A, the sliding member 20 is pulled rearwardly and until the forward sealing member A lies on the other side of the vent passage 52 thereby permitting the vent passage to communicate with the atmosphere, as illustrated by arrow 59 in FIG. 4C. In this position, the reduced diameter portion 91 places the chemical passage 32 in fluid communication with the chemical passage 31 in the housing, illustrated by arrow 60 in FIG. 4C. As described above, in this same position, the plunger 17 is withdrawn from the nozzle 47 such that carrier fluid can flow into the housing 14.

It should be appreciated that the sealing members 63, 65, A, C may be formed in several different manners. In one embodiment, the sealing portion is formed from a separate single sealing member that is positioned within a recess formed on the housing 14 (e.g., an O-ring). The sealing member is preferably made of a soft plastic elastomer material or other suitable synthetic rubber material. In other embodiments, the sealing members may be formed by integrally forming or coating an elastomer, rubber or rubber like material to form a tight seal. The sealing members 63, 65, A, C may in the alternative or in combination be placed in recesses on the connection portions 16, 18 or integrally formed therein or coated upon.

A detent 27 (FIGS. 1A and 1B) and corresponding opening may be provided between the housing 14 and the connection portion 18 to indicate and lock the assembly 10 in a closed and/or open position.

The illustrated assembly 10 described above is particularly adapted to be manufactured by injection molding. Because the assembly 10 will typically be discarded after the chemical is exhausted, the costs of manufacturing the assembly 10 may be low. Injection molding is a particularly low cost method of making parts out of plastic-type materials. Those of ordinary skill in the art will recognize that the sprayer head 14, the container connection portion 16, the supply fluid connection portion 18, the sealing member 64 and the control valve 20 can all be formed using injection molding.

Another advantage of the present invention is that the sprayer head 14, and preferably the valve 20, defines the metering orifice 74. As mentioned above, the diameters of the metering orifice 74 determine, for the most part, the dilution ratio of the sprayer assembly 10. Accordingly, to achieve a precise dilution ratio, tight tolerances may be used in the metering orifice 74.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A sprayer head assembly for dispensing a chemical; the sprayer head assembly comprising:

a carrier fluid connection portion that is configured to be connected to a carrier fluid source, the carrier fluid connection portion forming a carrier fluid passage that is placed in communication with a carrier fluid source when the carrier fluid connection portion is coupled to the carrier fluid source, the carrier fluid passage generally extending in a first direction, the carrier fluid connection portion including a carrier fluid sealing portion;

a chemical connection portion that forms a chemical passage, the chemical connection portion configured to be connected to a container to place the chemical passage in communication with a cavity in the container, and a body portion defining, at least in part, a first passage and a second passage, the first passage intersecting with the second passage, the body portion further including a second passage sealing portion;

wherein the body portion is moveable with respect to the carrier fluid connection portion in a second direction generally parallel to the first direction, the body portion being moveable between at least a first position in which the second passage sealing portion acts to prevent carrier fluid from being in communication with the first passage through the second passage and a second position in which the second passage sealing portion acts to allow carrier fluid to be in communication with the first passage through the second passage, the second passage sealing portion being displaced along the second direction as the body portion is moved from the first position to the second position.

2. The sprayer head assembly of claim 1, wherein in the first position the second passage sealing portion contacts the carrier fluid sealing portion to prevent carrier fluid from being in communication with the first passage through the second passage and in the second position the second passage sealing portion is displaced from the carrier passage sealing portion to allow carrier fluid to be in communication with the first passage through the second passage.

3. The sprayer head assembly of claim 1, wherein as the body is moved from the first position to the second position there is no relative movement between the second passage sealing portion and the first passage.

4. The sprayer head assembly of claim 1, wherein the chemical connection portion includes a vent passage that is in communication with the cavity in the container.

5. The sprayer head assembly of claim 1, wherein the chemical connection portion includes a chemical passage sealing portion and the body portion includes a first passage sealing portion, wherein in the first position of the body portion the chemical passage sealing portion contacts the first passage sealing portion to prevent the chemical passage from being in communication with the second passage through the first passage and in the second position the first passage sealing portion is displaced along the second direction from the chemical passage sealing portion to place the first passage in communication with the chemical passage.

6. The sprayer head assembly of claim 1, wherein the chemical connection portion and the carrier fluid connection portion are coupled together such that as the body portion moves between the first position and the second position there is no relative movement between the chemical connection portion and the carrier fluid connection portion.

7. The sprayer head assembly of claim 1, wherein the body portion includes a vent passage sealing portion and the chemical connection portion includes a corresponding vent passage sealing portion, and wherein in the first position the vent passage sealing portions of the body portion and the chemical connection portion contact to prevent the vent passage from being in communication with a venting source and in the second position the vent passages sealing portions are displaced along the second direction to place the vent passage in communication with a venting source.

8. The sprayer head assembly of claim 1, wherein the second passage forms in part a surface and the first passage has an opening positioned on the surface.

9. The sprayer head assembly of claim 1, wherein the assembly further comprises a sealing member coupled to the carrier fluid connection portion such that there is relative movement in the second direction between the body portion and the sealing member.

10. The sprayer head assembly of claim 9, wherein the sealing member a chemical passage sealing portion, the chemical passage sealing portion configured to prevent communication between the chemical passage and the second passage through the first passage when the body portion is in the first position and to allow communication between the chemical passage and the second passage through the first passage when the body portion is in the second position.

11. The sprayer head assembly of claim 1, wherein the body portion is coupled to the chemical connection portion such that there is no relative movement between the body portion and the chemical connection portion as the body portion is moved between the first position and the second position.

12. A sprayer head assembly for dispensing a chemical; the sprayer head assembly comprising:

a carrier fluid connection portion that is configured to be connected to a carrier fluid source, the carrier fluid connection portion forming a carrier fluid passage that is placed in communication with a carrier fluid source when the carrier fluid connection portion is coupled to the carrier fluid source;

a chemical connection portion that forms a chemical passage, the chemical connection portion configured to be connected to a container to place the chemical passage in communication with a cavity in the container, and a body portion defining, at least in part, a first passage and a second passage, the first passage intersecting with the second passage, the body portion further including a second passage sealing portion, the body portion further defining, at least in part, an outlet of the sprayer head assembly;

wherein the body portion is moveable with respect to the carrier fluid connection portion, the body portion being moveable between at least a first position in which the second passage sealing portion acts to prevent carrier fluid from being in communication with the first passage through the second passage and a second position in which the second passage sealing portion acts to allow carrier fluid to be in communication with the first passage through the second passage, wherein there is no relative movement between the second passage sealing portion and the first passage as the body portion is moved from the first position to the second position.

13. The sprayer head assembly of claim 12, wherein the chemical connection portion includes a vent passage that is in communication with the cavity in the container.

14. The sprayer head assembly of claim 12, wherein the chemical connection portion includes a chemical passage sealing portion and the body portion includes a first passage sealing portion, wherein, in the first position, the first passage sealing portion acts to prevent the chemical passage from being in communication with the second passage through the first passage and, in the second position, the first passage sealing portion acts to place the first passage in communication with the chemical passage.

15. The sprayer head assembly of claim 12, wherein the chemical connection portion and the carrier fluid connection portion are coupled together such that as the body portion moves between the first position and the second position there is no relative movement between the chemical connection portion and the carrier fluid connection portion.

16. The sprayer head assembly of claim 12, wherein the body includes a vent passage sealing portion and the chemical connection portion includes a corresponding vent passage sealing portion, and wherein in the first position the vent passage sealing portions of the body and the chemical connection portion act to prevent the vent passage from being in communication with an venting source and in the second position the vent passages sealing portions act to place the vent passage in communication with a venting source.

17. The sprayer head assembly of claim 12, wherein the second passage forms in part a surface and the first passage has an opening positioned on the surface.

18. The sprayer head assembly of claim 17, wherein the surface is coupled to the body portion.

19. The sprayer head assembly of claim 12, the assembly further comprising a sealing member coupled to the carrier fluid connection portion such that there is relative movement between the body portion and the sealing member.

20. The sprayer head assembly of claim 19, wherein the sealing member comprises a chemical passage sealing portion, the chemical passage sealing portion configured to prevent communication between the chemical passage and the second passage through the first passage when the body portion is in the first position and to allow communication between the chemical passage and the second passage through the first passage when the body portion is in the second position.

21. The sprayer head assembly of claim 12, wherein the body portion is coupled to the chemical connection portion such that there is no relative movement between the body portion and the chemical connection portion as the body portion is moved between the first position and the second position.

* * * * *